US005468272A

United States Patent [19]

Schmierer

[11] Patent Number: 5,468,272

[45] Date of Patent: Nov. 21, 1995

[54] FILTER BAG FOR VACUUM CLEANERS

[75] Inventor: Uwe Schmierer, Dietenhofen, Germany

[73] Assignee: Branofilter GmbH, Dietenhofen, Germany

[21] Appl. No.: 227,039

[22] Filed: Apr. 13, 1994

[30] Foreign Application Priority Data

May 7, 1993 [DE] Germany ..... 43 15 203.1

[51] Int. Cl.[6] ..... B01D 46/00

[52] U.S. Cl. ..... 55/367; 55/377

[58] Field of Search ..... 55/361, 367, 374, 55/376, 377

[56] References Cited

U.S. PATENT DOCUMENTS

| | | | |
|---|---|---|---|
| 2,804,167 | 8/1957 | Seck | 55/367 |
| 2,864,462 | 12/1958 | Brace | 55/367 |
| 5,158,635 | 10/1992 | Schmierer et al. | 156/367 |

FOREIGN PATENT DOCUMENTS

| | | | |
|---|---|---|---|
| 0362624 | 6/1993 | European Pat. Off. . | |
| 2407478 | 8/1974 | Germany . | |
| 0027162 | of 1908 | United Kingdom | 55/367 |

*Primary Examiner*—C. Scott Bushey
*Attorney, Agent, or Firm*—Flynn, Thiel, Boutell & Tanis

[57] ABSTRACT

A filter bag for a vacuum cleaner possesses a substantially plate-shaped connection member with a stationary two-part base body and a sliding door arranged between the two layers of the base body. The layers of the base body have aligned passage openings and the sliding door has a through opening, which in the open position of the sliding door is aligned with the passage openings. In the closed position the sliding door shuts off the passage openings. The base body has at least one abutment element, which fits into an abutment recess in the sliding door, the rim of the abutment recess constituting a terminal abutment striking against the abutment element at least in the closed position of the sliding door.

19 Claims, 3 Drawing Sheets

FILTER BAG FOR VACUUM CLEANERS

BACKGROUND OF THE INVENTION

The invention relates to a filter bag for vacuum cleaners, comprising a substantially plate-like connection member, which comprises a stationary base body with two superposed, aligned passage openings, more particularly manufactured of a board- or card-like material, and a sliding door, which is arranged between two base body layers and has a through opening, such door being more particularly made of film-like flexible material, the said sliding door extending outwards laterally between the base body layers and being able to be shifted from an open position, in which its through opening is in alignment with the passage openings, into a closed position closing the passage openings.

Both in the case of household vacuum cleaners and also of larger models able to be employed in industry filter bags—the term bag also including large filter sacks or the like—are used to receive the dust collected. In such equipment a suction current is produced by means of a vacuum cleaner blower which sweeps the dust into a suction duct, suction hose or the like and thence into the respective filter bag. The suspended dust in the drawn-in air is retained by the filter bag wall, whereas the air current free of dust passes through the filter bag wall and is then let off into the surroundings. Once the filter bag is full, it is removed and can be disposed of.

The fastening of the filter bag on the vacuum cleaner appliance is performed by means of the connection member attached to the filter bag adjacent to its inlet opening, such member being so arranged that the passage openings in the base body layers are in alignment with the inlet opening of the filter bag and all such openings together constitute an intake opening through which the dust laden air is introduced. With the aid of the sliding door it is possible for this intake opening or, respectively, the passage openings of the connection member to be shut, when the filter bag is moved from the vacuum cleaner appliance. It is in this manner that dust-is prevented from escaping from the discarded filter bag into the surroundings.

The German patent publication 2,407,478 A discloses a filter bag of the type initially mentioned, in the case of which the sliding door constituted by a paper strip has a folded end part bonded to the layers of the base body so that on tugging the projecting opposite end the folds are pulled out and the previously folded part takes up a position over the passage opening and closes the same.

Since the sliding door must be relatively long owing to its folds, this arrangement needs a relatively large quantity of material. In this respect it is to be taken into account that a relatively expensive special-purpose paper with a high tear strength has to be employed.

Furthermore the adhesive bonding of the end of the sliding door to one of the base body layers also involves the need not only for an additional manufacturing step but also the danger that the bond will not be able to withstand the force acting on the sliding door when closing the filter bag so that the sliding door may be completely withdrawn and the intake opening would be re-opened.

SHORT SUMMARY OF THE INVENTION

One object of the invention is therefore to create a filter bag of the sort noted initially, which as regards the sliding door is simplified and made cheaper and in the case of which a firm mounting of the sliding door on the base body is ensured.

In accordance with the invention this object is to be achieved since the base body possesses at least one abutment element, which fits into an abutment recess in the sliding door, whose rim constitutes a terminal abutment abutting the abutment element at least in the closed setting of the sliding door.

It is in this manner that the sliding door is interlockingly held on the base body so that it can not come clear of the base body, even when a strong pulling force is exerted on it. Owing to this feature there is no need for adhesive bonding in the prior art device of the inner end of the sliding door and in connection with it a folding of the sliding door is no longer necessary, that is to say the sliding door may have shorter, flat form. Furthermore there is then a more effective sealing action as regards escape of dust in the closed position since owing to the absence of folds in the sliding door the two layers of the base body are arranged directly to the side thereof closer together on top of each other. Further advantageous forms of the invention are recited in the claims.

Further advantageous developments and convenient forms of the invention will be understood from the following detailed descriptive disclosure of embodiments thereof in conjunction with the accompanying drawings.

LIST OF THE SEVERAL VIEWS OF THE FIGURES

DETAILED ACCOUNT OF WORKING EMBODIMENTS OF THE INVENTION

Figure 1:
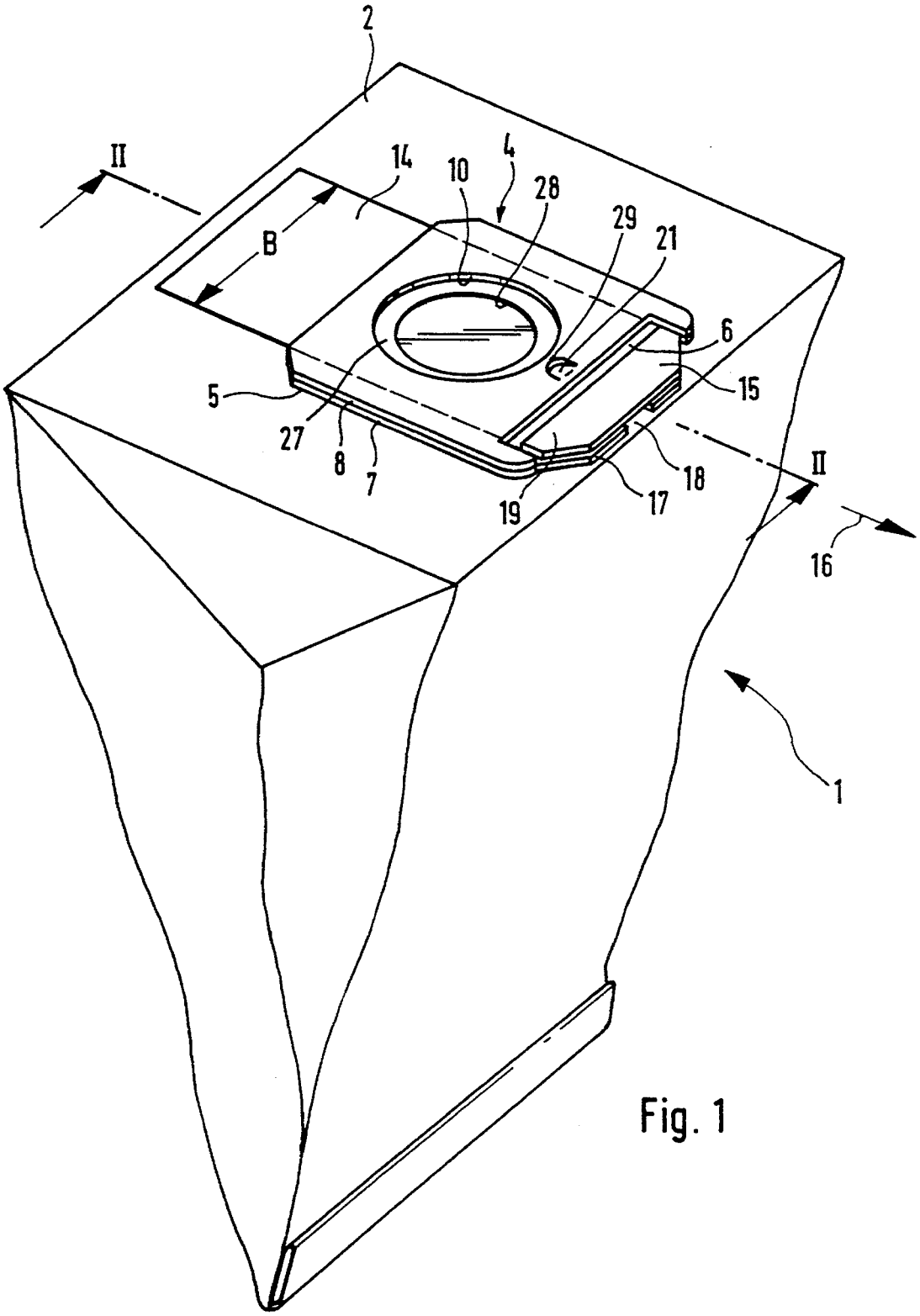
FIG. 1 shows a filter bag with a first embodiment of the connection member in accordance with the invention in an oblique elevation.

The filter bag 1—which might also be termed a filter sack or the like—depicted in FIG. 1 diagrammatically consists of a material (such as paper or non-woven material or the like) permeable to air and is employed in vacuum cleaner equipment. In the unused condition the filter bag 1 is folded up and possesses a flat configuration. During use, that is to say in the condition fitted in the vacuum-cleaner, it is inflated by the air current produced and then unfolds.

The front wall 2 of the filter bag as such, i.e. the front wall of the filter bag constituted by the filter material, has an inlet opening 3, at which a connection member 4 is attached externally to the filter bag. In this respect it might also be a question of the connection member 4*a* depicted in FIG. 5, which will now be described in connection with connection member 4, like parts being denoted by like reference numerals in the two cases but with the addition of a letter "a" in, the case of FIG. 5. The connection member 4 or 4*a* serves for the connection of the filter bag 1 with a connection port of the appliance, which is inserted through the connection member 4 or 4*a* and through the inlet opening 3 of the filter bag's front wall 2.

The configuration of the connection member 4 or 4*a* is essentially plate-like. Its outline is like that of a rectangle, but it might be differently designed. The connection member 4 or 4*a* consists essentially of a base body 5 or 5*a* and a sliding door 6 or 6*a*. In this respect the base body 5 is made up of two superposed base body layers 7 and 7*a* and furthermore 8 and 8*a* or plies, which consist of board- or card-like material, although as a matter of principle they might consist of, for example, plastic or the like. In this respect it is a question of relatively stiff material so that the base body 5 and 5*a* always assumes its flat configuration and can be slipped onto the connection port on the appliance without any difficulties. Each layer 7 and 7*a* and furthermore 8 and 8*a* of the base body has a passage opening 9 and 9*a* and furthermore 10 and 10*a*, the two passage openings being arranged in alignment with one another. In the case of the connection member attached to the bag wall 2 the two passage openings are furthermore in alignment with the inlet opening 3 so that the two passage openings 9 and 9*a* and furthermore 10 and 10*a* of the connection member 4 and 4*a* with the inlet opening 3 constitute a bag inlet opening.

Figure 2:
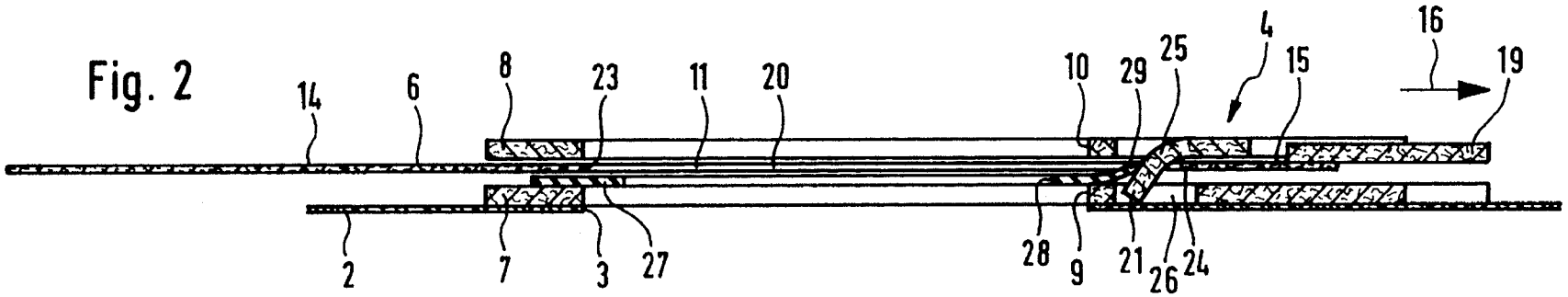
FIG. 2 shows the abutment member of the filter bag illustrated in FIG. 1 in a longitudinal median section-in the direction of setting taken of the section line II—II on a larger scale, the sliding door being in its open position.
Figure 3:
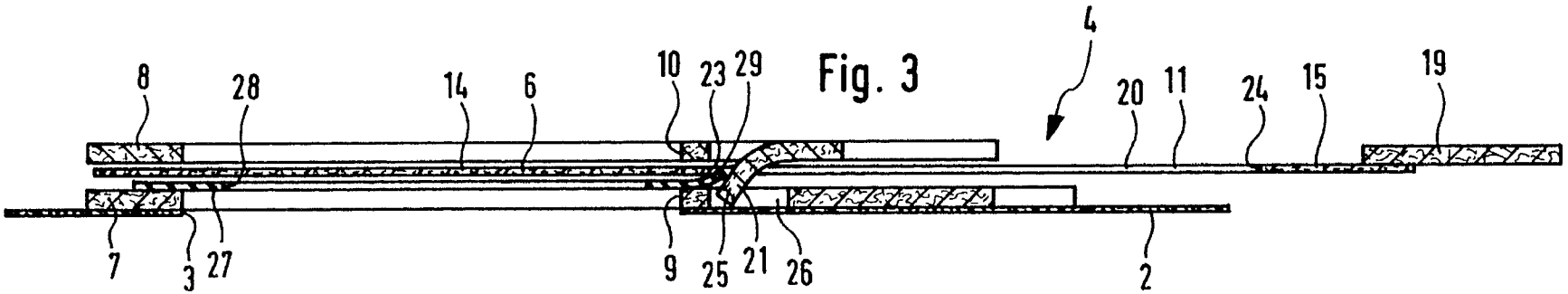
FIG. 3 shows the arrangement in accordance with FIG. 2 with the sliding door moved into its closed position.
Figure 4:
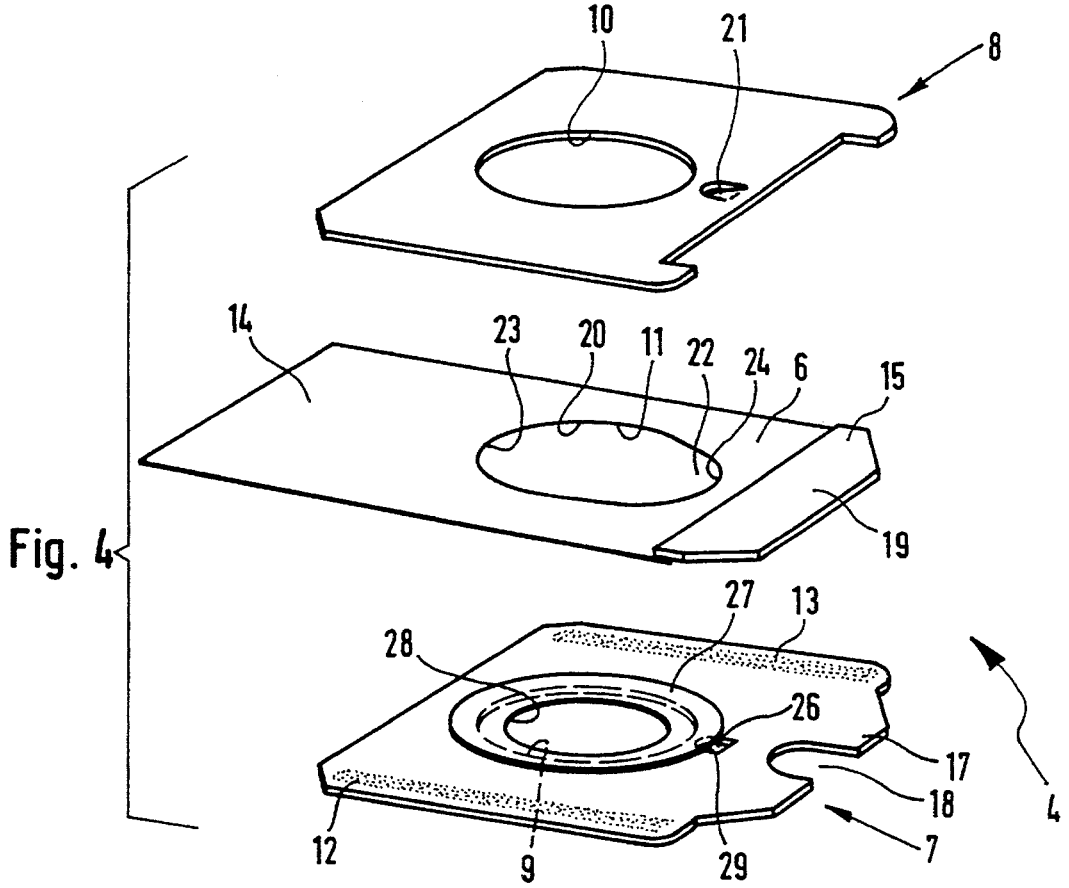
FIG. 4 shows an oblique, exploded view of the connection member in accordance with FIGS. 1 through 3.

The sliding door 6 and 6*a* is positioned between the two base body layers 7 and 7*a* and has a through opening 11 and 11*a* corresponding to the passage openings 9 and 9*a* and furthermore 10 and 10*a*. In this respect the sliding door 6 and 6*a* is located in its initial position, in which the connection member 4 and 4*a* may be slipped onto the connection port of the appliance, in its open position (FIGS. 1 and 2) in which the through opening 11 and 11*a* is arranged in alignment with the passage openings 9 and 9*a* and furthermore 10 and 10*a*. The sliding door 6 and 6*a* is furthermore guided for linear sliding motion between the two layers 7 and 7*a* and furthermore 8 and 8*a* of the base body, since it has a smaller width than the base body layers and the two base body layers 7 and 7*a* and furthermore 8 and 8*a* are attached on either side of the sliding door 6 and 6*a* at their side rim parts. This attachment may for example be by adhesive bonding. In FIG. 4 two such adhesive strips 12 and 13 are indicated in the case of the base body layer 7. In FIGS. 2 and 3 the two base body layers 6 and 7 are not shown connected together and with a somewhat greater spacing between them than in reality in order to make the drawing more straight-forward.

The sliding door 6 and 6*a* may be moved between its open position into a closing position covering the passage openings 9 and 9*a* and furthermore 10 and 10*a*, in which position the through opening 11 and 11*a* is arranged outside the zone with the through openings so that it covers the same with a non-perforated closing part 14 and 14*a*. Such closing takes place when a filled filter bag is taken from the vacuum cleaner and it is then impossible for any further dust to escape when handling the bag. In order for the sliding door 6 and 6*a* to be gripped by the user, it has a handle part 15 and 15*a* projecting in its open position as well in the direction 16 and 16*a* of setting between the base body layers 7 and 7*a*. By pulling in the direction 16 and 16*a* of setting it is moved into the closed position.

The sliding door 6 and 6*a* consists of a film-like, flexible material, which possesses a tear resistance commensurate with the forces occurring. In principle it would be possible, instead of such a flexible strip of material, to have a stiffer or more rigid sliding door.

In the case of the embodiments of the invention the base body layer 7 or 7*a* which is nearer the bag wall, is drawn on the side of the handle part 15 and 15*a* of the sliding door 6 and 6*a* past the base body layer 8 and 8*a* remote from the bag wall so that the handle part 15 and 15*a* is supported. This drawn out part 17 and 17*a* is provided with a finger hole 18 and 18*a* so that the handle part 15 and 15*a* can be engaged from either side.

In the case of embodiments of the invention the base body layer 8 and 8*a* further from the bag wall 2 and 2*a* has a U-like recess in the handle part 15 and 15*a* of the sliding door 6 and 6*a*, this however not being absolutely essential.

In order to make it easier to grip it is possible for the handle part 15 and 15*a* of the sliding door 6 and 6*a* to be furnished with a more rigid handle part 19 and 19*a* attached to the paper-like flexible material and which can be a bonded on board- or card-like material.

In its open position the sliding door 6 and 6*a* has its part opposite to the handle part 15 and 15*a* also projecting between the base body layers. This part constitutes the closed sliding door part 14 and 14*a*, which on transfer into the closed position takes up a position between the base body layers and shuts off the passage openings therein.

The sliding door 6 and 6*a* has a single layer structure throughout and in the open position projects freely out of the base body. The lengths of the base body 5 and 5*a* and of the sliding door 6 and 6*a* as measured in the direction 16 and 16*a* of movement can be so selected that in the closed position the sliding door end opposite to the handle part 15 and 15*a* is within or outside the base body. If this sliding door projects from the base body in the closed position as well, it is possible for the sliding door to be retracted again into the open position by pulling this end of it out of the closed setting, if indeed this possibility is desired at all.

On moving the sliding door 6 and 6*a* out of the open position into the shut position it is necessary to ensure that the sliding door is not drawn in the setting direction 16 and 16*a* past the closed setting and out of the base body. For this purpose there is a provision of at least one abutment element on the base body 5 and 5*a*, which fits into an abutment recess in the sliding door 6 and 6*a*, whose rim recess constitutes a terminal abutment, at least in the closed position of the sliding door 6 and 6*a* striking against the abutment element so that the amount of movement of the sliding door is limited. In this respect the at least one abutment recess preferably has a length equal to setting movement of the sliding door 6 and 6*a* so that the rim of the recess constitutes a terminal abutment in either position of the sliding door, i.e. not only in the closed position but also in the open position thereof.

The sliding door 6 and 6*a* can consequently be arranged, apart from the at least one abutment element, without any connection with the base body layers 7 and 7*a* and furthermore 8 and 8*a* and be guided between them.

The two embodiments of the invention illustrated in the drawings merely differ as regards abutment elements and the abutment recesses.

In the case of the particularly simple embodiment of the invention in accordance with FIGS. 1 through 4 the abutment recess 20 formed in the sliding door 6 is formed by the through opening, present in any case. In this respect the abutment element 21 is arranged on the base body 5 at half the width of the through openings 9 and 10 so that the abutment element 21 fits into the through opening 11 on the center line of the through opening 11 and extending in the direction 16 of setting. As will be furthermore seen from FIGS. 1 through 4, the abutment element 21 is arranged in the setting direction 16, that is to say in the closing direction of the sliding door short of the through openings 9 and 10 of the base body layers 7 and 8, i. e. in the part between the through openings and the end nearer to the handle part 15 of the sliding door 6.

The through opening 11 of the sliding door 6 is made so large that the abutment element 21 is also located in it in the open position. The through opening 11 hence has form which is made wider than the passage openings 9 and 10 of the base body layers. This wider form 22 of the through opening 11, in which the abutment element 21 is located in the open position, is indicated more especially in FIG. 4.

The part of the rim, opposite to the handle part 15, of the abutment recess 20 or, respectively, the through opening 11 constituting the same, forms the above mentioned terminal abutment 23, against which the abutment element 21 strikes when the sliding door 6 runs into the closed position.

The through opening 11 constituting the abutment recess 20 is furthermore so long that the part, which is adjacent to the handle part 15, of the rim of the through opening 11 forms second terminal abutment 24, against which the abutment element 21 abuts in the open position of the sliding door 6. The length of the through opening 11 is consequently equal, as already mentioned, to the length of the movement of the sliding door 6 so that the sliding door is secured both in the open position and also in the closed position to prevent further displacement.

Figure 5:
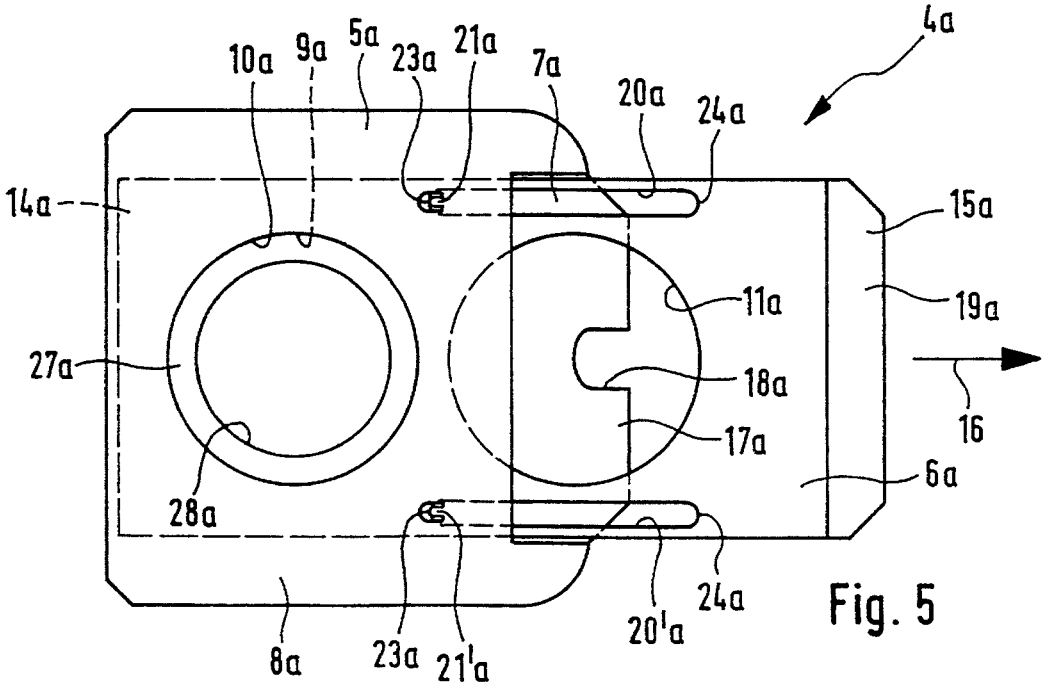
FIG. 5 shows a second embodiment of the invention of the connection member in a plan view with the sliding door located in the closed position.

Instead of the through opening, which is present in any case, it is possible for the at least one abutment recess also to be formed by a longitudinally extending slot in the sliding door, as is in fact the case with the embodiment of the invention in accordance with FIG. 5. Here the sliding door 6*a* has two abutment recesses 20*a* and 20'*a* in the form of longitudinally extending slots extending in the setting direction 16*a*, into which there respectively fits an abutment element 21*a* and, respectively, 21'*a* arranged on the base body 5*a*. In principle it would be possible to have merely a single longitudinally extending slot with an associated abutment element. The two longitudinally extending slots present in the working embodiment and constituting the abutment recesses 20*a* and 20'*a* are arranged transversely in relation to the setting direction 16*a* on either side of the through opening 11*a*. It will be seen from this that the sliding door 6*a* of the embodiment of the invention in accordance with FIG. 5 has to be wider by an amount equal to space requirement of the at least one longitudinally extending slot 20*a* and 20'*a* than the sliding door 6 of the embodiment of the invention in accordance with FIGS. 1 through 4. In the case of there being two longitudinally extending slots the guiding effect is more pronounced than is the case with merely one longitudinally extending slot and the sliding door is more securely held and prevented from dropping out.

The end, remote from the handle part 15*a*, of the longitudinally extending slots 20, 20'*a* and, respectively, the longitudinally extending slot rim present here constitutes the terminal abutment 23*a* associated with the closed setting.

Since the length of the longitudinally extending slots 20*a* and 20'*a* is the same as that of the travel or movement of the sliding door 6*a*, the end of the longitudinally extending slot nearer the handle part 15*a* or, respectively, the rim of the recess located here also constitutes a terminal abutment 24*a*, which like the terminal abutment 24 of the working embodiment in accordance with FIGS. 1 through 4, corresponds to the open position, i. e. in the open position of the sliding door 6*a* the abutment elements 21*a* and 21'*a* abut this second, terminal abutment 24*a*.

As a modification of the two embodiments of the invention would be possible to cause the abutment element of the base body only to strike the respective rim position of the abutment recess of the sliding door in the closed setting, i. e. the respective abutment recess might be extended towards the handle part of the sliding door. In order in such a case to also have an abutment for the open position, it would for example be possible to attach, for instance, the handle portion 19 and 19*a* o the sliding door 6 and 6*a* in such a manner that it strikes the front edge of the nearer base body layer 8 and 8*a*.

In the case of embodiments of the invention, however, as shown in FIG. 1, in the open position there is a distance between the handle part 15 and 15*a* of the sliding door 6 and 6*a* on the one hand and the respective base body layer 8 and 8*a* on the other hand in the direction 16 and 16*a* of movement.

In both embodiments of the invention the abutment elements are formed to be identical to one another. Such design of the abutment elements will now be explained with reference only to FIGS. 2 and 3, although the description also applies for the embodiment of the invention in accordance with FIG. 5 and, respectively, the abutment elements thereof.

In a fashion providing for simplicity of manufacture the abutment element 21 is constituted by an abutment lug 25 shaped integrally with the base body layers. In this case the abutment lug 25 is best arranged on the base body layer 8 remote from the filter bag and consequently bent toward the base body layer 7 attached to the bag wall 2. Such a lug can be produced by suitable stamping from the base body layer 8, after which it merely has to be bent out of the plane of the base body layer. The other base body layer 7 has a recess at the position of the abutment lug 25 seated on the base body layer 7, and the abutment lug 25 may fit into such recess 26 so that it can extend over the intermediate space between the two base body layers. The abutment lug 25 is furthermore best directed oppositely to the direction of closing, that is to say opposite to the direction 16 of movement and its free lug end is turned away from the handle part of the sliding door.

The base body layer 7 and 7*a* is attached by adhesive bonding to the bag wall. In such a case it is convenient to bond the abutment lug 25 on the bag wall 2 as well. The abutment lug 25 in fact extends through the recess 26 towards the bag wall 2 so that it may be simultaneously bonded or stuck to the base body layer 7 on the bag wall 2.

In both embodiments of the invention a perforated sealing diaphragm 27 and 27*a* is arranged at the position of the passage openings 9 and 9*a* and furthermore 10 and 10*a*, such diaphragm being manufactured of rubber-elastic material, the area of the diaphragm hole 28 and 28*a* being smaller than the area of the passage openings of the layers of the base body. It is in this manner that an annular seal is constituted which is directed inwards which on slipping connection member 4 and 4*a* on the connection port on the appliance will fit snugly against the wall thereof. In the embodiment of the invention in accordance with FIG. 1 through this sealing diaphragm performs a further function in connection with the abutment lug 25 in the embodiment of the invention as follows:

The sealing diaphragm 27 is attached to the base body layer 7 having recess 26, preferably by adhesive bonding. In this case it is made with such a size and the recess 26 is so arranged that an outer edge part 29 of the diaphragm 27 transverses the recess 26, that is to say the diaphragm 27 extend somewhat over the recess 26 forwards. The abutment lug 25 is not bent so far that it fits underneath the sealing diaphragm's outer edge part 29. It is in this manner that the outer edge part 29 of the sealing diaphragm 27 constitutes a ramp surface for the sliding door 6 arranged between the sealing diaphragm 27 and the abutment lug 25, when the latter comes into the closed position (FIG. 3). The sliding door part constituting the terminal abutment 23 consequently slides onto the outer edge part of the sealing diaphragm.

I claim:

1. A filter bag for a vacuum cleaner comprising:

a filter bag body, said filter bag body being formed with an inlet opening;

a base unit attached to said filter bag body adjacent said bag body opening, said base unit having two spaced apart body layers, said body layers each being formed with an opening, said body layer openings being concentric with said bag body opening;

a door slidably disposed between said body layers, said door having a first section formed with a door opening that can be selectively positioned in alignment with said body layer openings to place said door in an opened position and said door being further adapted so as to move said door opening out of alignment with said body layer openings so that a second section of said door is located substantially between said body layer openings to place said door in a closed position; and an abutment element attached to one said body layer and positioned to extend into said door opening when said door is moved to said closed position.

2. The filter bag as claimed in claim 1, wherein: said door opening has a center axis along which said door is moved from said open position to said closed position; and the abutment element is positioned to extend into said door opening along said center axis.

3. The filter bag as claimed in claim 2, wherein: said base unit body layer openings each have a rear section, said rear section being adjacent said door second section when said door is in said open position and a front section distal from said door second section when said door is in said closed position; and said abutment element is located adjacent said front sections of said base body layer openings.

4. The filter bag as claimed in claim 1, wherein in order to receive said abutment element said door opening has a diameter wider than the adjacent diameters of said base body layer openings.

5. The filter bag as claimed in claim 1, wherein: one said body layer is proximal to said filter bag and the other of said body layers is distal from said filter bag; and said abutment element is positioned on said base body layer distal from the filter bag.

6. The filter bag as claimed in claim 1, wherein said base unit body layer opposite said body layer to which said abutment element is attached is formed with a recess adjacent said abutment element.

7. The filter bag as claimed in claim 1, wherein, one of said base body layers is bonded to said filter bag said abutment element is also bonded to said filter bag.

8. The filter bag as claimed in claim 1, wherein the abutment element is oriented in a direction opposite the direction said door is displaced when moved from said open position to said closed position.

9. The filter bag as claimed in claim 6, wherein a sealing diaphragm of rubber-elastic material is arranged between the two base body layers at the position of said body layer openings, said diaphragm being formed with an aperture smaller than the aperture size of said body layer openings, and wherein the sealing diaphragm is attached to the base body layer having the recess and said diaphragm is formed with an outer rim traversing said recess and furthermore the abutment element fits underneath the outer rim part of the diaphragm so that on moving said door into the closed position, said door part which constitutes a terminal abutment slides onto the outer rim of the diaphragm.

10. A filter bag for a vacuum cleaner comprising:

a filter bag body, said filter bag body being formed with an inlet opening;

a base unit attached to said filter bag body adjacent said bag body opening, said base unit having two spaced apart body layers, said body layers each being formed with an opening, said body layer openings being concentric with said bag body opening;

a door slidably disposed between said body layers, said door having a first section formed with an opening that can be selectively positioned in alignment with said body layer openings to place said door in an opened position and said door being further adapted so as to move said door opening out of alignment with said body layer openings so that a second section of said door is located substantially between said body layer openings to place said door in a closed position, said door further being formed with an abutment opening; and an abutment element attached to one said base unit body layer and positioned to extend into said door abutment opening when said door is in said closed position so as to prevent removal of said door from said base unit when said door is moved from said open position to said closed position.

11. A filter bag of claim 10, wherein said door opening functions as said abutment opening.

12. A filter bag of claim 10, wherein said abutment element is located on said base unit body layer remote from said filter bag body.

13. A filter bag of claim 10, wherein said base unit body layer opposite said body layer to which said abutment element is attached is formed with a recess adjacent said abutment element so that when said abutment element extends into said abutment opening, said abutment element extends into said body layer recess.

14. A filter bag of claim 10, wherein:

a first one of said base unit body layers is located adjacent said filter bag body and is secured thereto and a second one of said base unit body units is disposed over said first body layer so as to be distal from said filter bag body;

said abutment member is attached to said distal base unit body layer and is oriented toward said adjacent base unit body layer;

said adjacent base unit body layer is formed with a opening positioned so that said abutment element extends through said door abutment opening and said body layer opening and contacts said filter bag; and an adhesive is applied to said filter bag body in the vicinity of said adjacent base unit body layer opening for bonding said abutment element to said filter bag.

15. A filter bag of claim 10, wherein said abutment element is directed angularly down away from said base unit body layer to which said abutment element is attached so as that said abutment element is directed away from a direction said doors is displaced when said door is moved from said open position to said closed position.

16. A filter bag of claim 13, further including a sealing diaphragm attached to said base unit body layer forming said recess, said diaphragm being disposed between said body layers around said body layer openings having an aperture with a diameter less than the diameter of said body layer openings and said diaphragm having an outer rim which extends over said base unit body layer recess so that the said abutment element fits underneath said outer rim so that upon displacing said door to said closed position, a portion of said door slides onto said diaphragm outer rim.

17. A filter bag of claim 10, wherein said door forms two said abutment openings, said abutment openings being in the form of longitudinally aligned slots positioned along axes parallel to an axis along which said door is displaced from of said open position to said closed position and said abutment openings are located along opposed sides of said door opening and said filter bag further includes two abutment elements attached to one said body layer, each said abutment element positioned to extend into a separate one of said abutment openings.

18. The filter bag as claimed in claim 10, wherein said abutment opening has a length equal to the displacement of said door so as to define an opening rim that constitutes a terminal abutment in either position of said door.

19. The filter bag as claimed in claim 10, wherein said abutment opening has the form of a longitudinally extending slot.

* * * * *